United States Patent [19]

Lauri et al.

[11] 4,376,008

[45] Mar. 8, 1983

[54] APPARATUS FOR BINDING SHEETS OF PAPER

[76] Inventors: Huotari Lauri, Tammihaant, 2 B 13, Espoo 72; Pentti J. Leskinen, Mariank 24 E44, Helsinki 17, both of Finland

[21] Appl. No.: 266,205

[22] Filed: May 22, 1981

[30] Foreign Application Priority Data

May 22, 1980 [FI] Finland ..... 801670

[51] Int. Cl.³ ..... B42C 9/00

[52] U.S. Cl. ..... 156/578; 118/258; 118/259; 156/499; 156/574; 156/579; 412/37

[58] Field of Search ..... 156/578, 579, 546, 547, 156/548, 574, 575, 499; 118/258, 259; 412/37

[56] References Cited

U.S. PATENT DOCUMENTS

| | | | |
|---|---|---|---|
| 1,965,753 | 7/1934 | Scoles | 118/258 |
| 2,523,860 | 9/1950 | Budden | 412/37 X |
| 2,898,618 | 8/1959 | Whitfield | 118/259 |
| 3,453,138 | 7/1969 | Chen et al. | 118/259 |
| 3,762,365 | 10/1973 | Herzog | 118/259 |

*Primary Examiner*—Michael G. Wityshyn
*Attorney, Agent, or Firm*—McGlew and Tuttle

[57] ABSTRACT

An apparatus for binding sheets with so called hot-melt adhesive is disclosed. The apparatus includes a body, an adhesive container and heating element. A roller is rotatably fitted in an opening formed at the bottom of the adhesive container. The roller is fitted into the opening so tightly that particular stuffing elements become unnecessary. Moreover, the surface of the roller is provided with grooves or other asperate figures.

1 Claim, 1 Drawing Figure

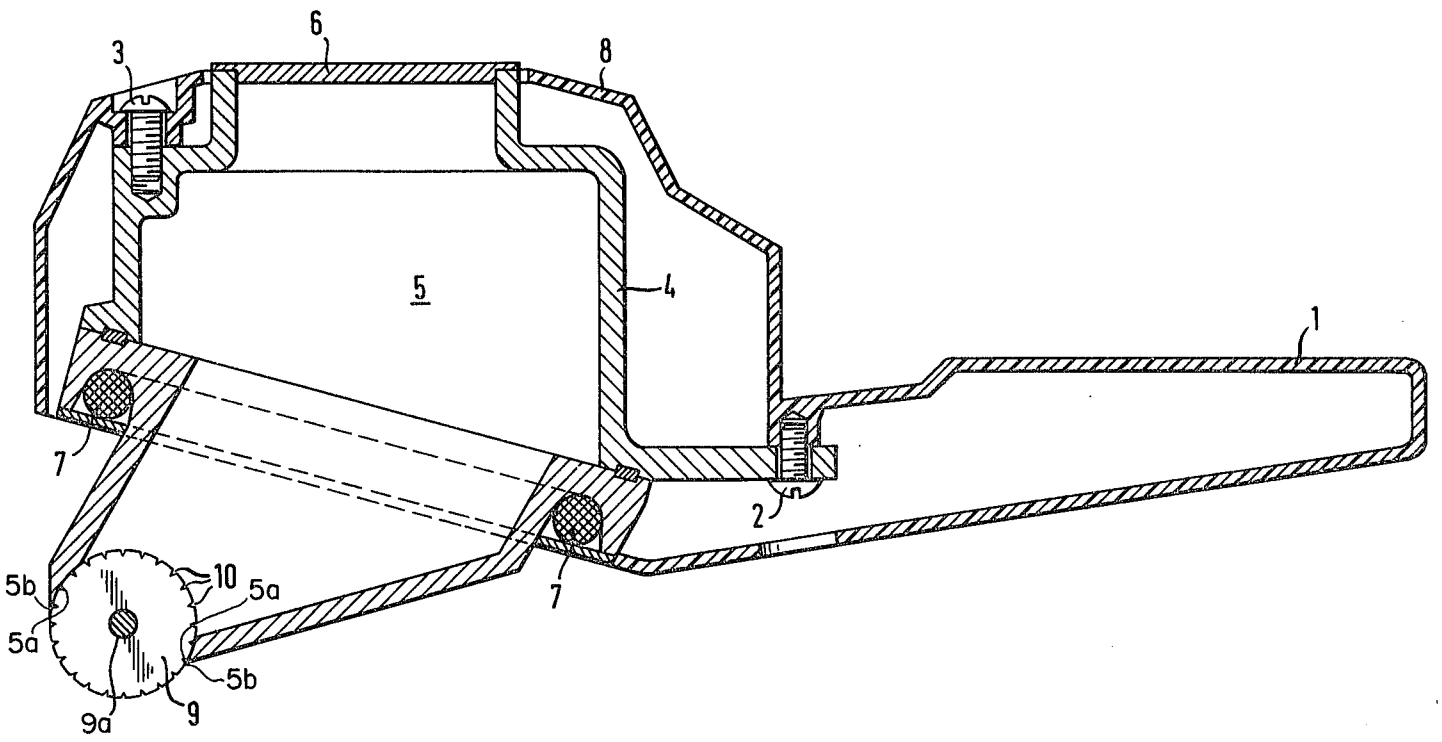
1
2
3
4
5
6
7
7
8
9
9a
10
5a
5b
5a
5b

APPARATUS FOR BINDING SHEETS OF PAPER

FIELD AND BACKGROUND OF THE INVENTION

The present invention relates to an apparatus for binding sheets of paper, for example computer sheets, by using so-called hot-melt adhesive. The apparatus comprises a body provided with a handle, an adhesive container located within the body, heating means for maintaining the adhesive at the required proportioning temperature, as well as proportioning means.

In the prior art method presented in the Finnish Patent Application no 780 922 for binding sheets of paper, the sheets are bound by employing a cover made, for example, of cardboard. A thermoplastic layer of adhesiver material is located in the inside of the back of the cover. The layer is melted by heating so that it sticks the sheets to each other and to the cover. The aforesaid patent application also introduces a nozzle for producing the adhesive belt in the back of the cover. The nozzle is meant to be attached to a normal hot-melt unit. The melted adhesive is pumped from the hot melt to the unit nozzle. The temperature of the adhesive located in the nozzle is kept suitable by means of electric resistances and a thermostat placed in the nozzle. The proportioning of the adhesive takes place through a hole located in the nozzle. The form of the hole conforms to the cross-section of the adhesive layer desired in the back of the cardboard cover.

In the prior art, there are also known various portable pistols for spreading hot-melt adhesive. An example is the apparatus presented in the British Patent Publication no 1 517 821. All previously known proportioning means have one characteristic in common, namely the feature that the melted adhesive is pressed onto the desired working surface through a suitable nozzle.

The above described method for binding sheets by means of special covers has several drawbacks. According to the thickness of the bunch of sheets to be bound, it is necessary to have several covers with varying sizes. The use of covers involves certain costs irrespective of the width of the covers. The sticking of the sheets to the cover is not always complete because the cardboard cover is a good heat insulator and the hot-melt adhesive may not always melt in a manner so as to be sufficiently liquid in order to provide for a perfect agglutination result. Moreover, the cardboard covers are not always desirable, or even suitable.

The use of previously known hot-melt pistols is not recommended for binding sheets because by employing a pistol having a standard width it is extremely difficult to create an even layer of adhesive, exactly of the same width as the bunch of sheets to be bound. If the nozzle is narrower than the bunch of sheets, all sheets will not be bound firmly enough. If the nozzle is wider than the bunch of sheets, the adhesive spreads all over. In any case, it is practically impossible to guide the nozzle manually.

SUMMARY OF THE INVENTION

The object of the present invention is, among other things, to eliminate the above described drawbacks and to create an apparatus which facilitates a quick and easy binding of sheets into bunches of variable thicknesses. In order to achieve this, the apparatus according to the present invention is characterized in that the proportioning means includes a roller rotatably fitted into an opening formed at the bottom of the adhesive container by the features pointed out mainly in the Patent Claim 1.

The most remarkable advantage of the apparatus is, in addition to its simplicity and easy use, the feature that the same apparatus can be employed for quickly binding both thick and thin bunches of sheets. The agglutination is neat and no adhesive is wasted.

Thus, in accordance with the invention, there is provided an improved apparatus for binding sheets of paper, for example, computer sheets, by using so-called hot-melt adhesives, the apparatus being of the type having a body, a handle connected to the body, the body including a compartment located inside the body for containing the adhesive, heating means mounted to the body for heating the adhesive and proportioning means for passing the adhesive to the sheets of paper to be bound, the improvement wherein the body has a discharge opening extending along a lower edge thereof and the proportioning means includes a roller rotatably fitted into said opening formed at the bottom of the compartment.

It is a further object of the invention to provide an improved apparatus for binding sheets of paper, by using so-called hot melt adhesive, which is simple in design, rugged in construction and economical to manufacture.

For an understanding of the principles of the invention, reference is made to the following description of a typical embodiment thereof as illustrated in the accompanying drawings.

BRIEF DESCRIPTION OF THE DRAWING

The sole FIGURE is a cross-sectional representation in apparatus for binding sheets in accordance with the preferred embodiment of the invention.

DETAILED DESCRIPTION

The apparatus according to the invention comprises a plastic handle 1, which is attached to a body 4 by means of screws 2 and 3. An adhesive container 5, is formed within the body 4 compartment, designed for containing the hot-melt adhesive. The container 5 is provided with a 6, which lid can be closed and opened, and covered with the electric resistance 7. By means of the electric resistance 7 the temperature of the metal container 5 is kept suitable for the adhesive in question, for example 170° C. In order to improve the working conditions, the plastic member forming the handle 1 continues to form the thermal coating 8 covering the whole body 5.

In connection with the container 5 is also placed the thermostat, which is not represented in the illustration. By means of the thermostat, the temperature of the container and the adhesive therein can be maintained within required limits. The apparatus is also provided with a signal light or other indicator, which informs the operator of the apparatus that the required temperature is achieved and operation can be started. These devices are neither represented in the drawing.

A roller 9 is fitted to an opening at the lower edge of the bottom of the container 5. The roller 9 is closely fitted into the opening so tightly that the liquid adhesive does not flow out through the seams. On the surface of the roller 9 is formed 10, which grooves are parallel to the lengthwise axis of the roller. The grooves 10 are filled with melted adhesive, and while pushing the roller 9 along the side of the bunch of sheets to be bound, these grooves dispose the adhesive onto the side of the bunch. The width of the roller 9 is such, for example 50 mm, that it is sufficient for most binding purposes. Moreover, it is naturally possible to draw several layers of adhesive side by side. It is characteristic of the apparatus according to the invention that even when the bunch of sheets is narrower than the roller 9, the roller does not dispose more adhesive than corresponds to the bunch in question. Only those sheets that touch the roller take the adhesive from the roller. Those areas of the roller which do not touch the sheets, keep their adhesive. The roller 9 is so tightly fitted into the hole that stuffing (packing) elements are not necessary.

The container opening has opposite parallel hinges 5*a* which have surfaces that lie on a common cylinder of a selected diameter. Roller 9 has substantially the same diameter and coincides with the common cylinder thus being tightly fitted into the opening and against the edges 5*a*. The outer ends 5*b* of edges 5*a* extend beyond the center 9*a* of the roller with respect to the compartment opening.

In the above description the present invention has been explained only with reference to one preferred embodiment. It is, however, clear that the scope of the invention is by no means limited to include only the above example. On the contrary, the practical applications of the invention can be considerably modified without deviating from the patent claims presented below. Consequently, the gearing of the roller 9 can be carried out by several different means. Similarly, the grooves 10 formed on the surface of the roller 9 can be replaced by other asperated configurations, and at least the outer surface of the roller can be made of porous material.

We claim:

1. An improved apparatus for binding sheets of paper using hot-melt adhesive, the apparatus being of the type having a body, a handle connected to the body, the body including a compartment for containing the adhesive, heating means mounted to the body for heating adhesive in the compartment, and proportioning means for passing the adhesive to the sheets of paper to be bound, the improvement wherein the body comprises a discharge opening having opposite parallel opening edges, said discharge opening communicating with the compartment and extending along the bottom thereof, said edges having surfaces lying in a common cylinder of a selected diameter, the proportioning means comprising a roller rotatably fitted into said discharge opening formed at the bottom of the compartment and having a diameter substantially the same as said selected diameter, said roller coinciding with said comon cylinder and being closely fitted into said discharge opening and against said opposite parallel opening edges without stuffing elements, said roller having a plurality of grooves therein extending parallel to a longitudinal axis of said roller, whereby hot-melt adhesive from said compartment enters said grooves but is otherwise removed from said roller by said opening edges with rotation of said roller, to apply adhesive only to sheets of paper contacting said roller, said roller having a center of rotation, outer ends of said parallel opening edges extending beyond said roller center of rotation with respect to said discharge opening.

* * * * *